US005924157A

United States Patent [19]

Barela

[11] Patent Number: 5,924,157

[45] Date of Patent: Jul. 20, 1999

[54] SURFACE CLEANING APPLIANCE

[76] Inventor: Mary V. Barela, 5312 Edgeware Dr., Agoura Hills, Calif. 91301

[21] Appl. No.: 09/005,765

[22] Filed: Jan. 12, 1998

[51] Int. Cl.[6] ..... A47L 13/00

[52] U.S. Cl. ..... 15/104.002; 15/144.1; 15/144.4; 15/230.11

[58] Field of Search ..... 15/104.002, 144.1, 15/144.3, 144.4, 230.11

[56] References Cited

U.S. PATENT DOCUMENTS

| | | | |
|---|---|---|---|
| 2,542,774 | 2/1951 | Hutchinson | 15/230.11 X |
| 3,273,192 | 9/1966 | Mazzella | 15/230.11 |
| 3,407,424 | 10/1968 | Lanzarone et al. | 15/144.4 X |
| 3,742,547 | 7/1973 | Sohmer | 15/104.002 |
| 4,196,491 | 4/1980 | Baril | 15/144.4 X |
| 4,299,005 | 11/1981 | Brown | 15/144.1 X |
| 4,361,923 | 12/1982 | McKay | 15/104.002 |
| 4,528,714 | 7/1985 | Beck | 15/144.1 X |
| 4,640,539 | 2/1987 | La Porte | 294/19.1 |
| 4,727,616 | 3/1988 | Kucera et al. | 15/104.002 |
| 4,926,522 | 5/1990 | Wang | 15/144.1 X |
| 5,033,155 | 7/1991 | Klotz | 15/144.4 X |
| 5,343,587 | 9/1994 | Findley | 15/144.4 X |
| 5,553,344 | 9/1996 | Rosenkrantz | 15/104.002 |

FOREIGN PATENT DOCUMENTS

| | | | |
|---|---|---|---|
| 276297 | 2/1966 | Australia | 15/144.1 |
| 171869 | 2/1986 | European Pat. Off. | 15/104.002 |
| 1247167 | 10/1960 | France | 15/144.1 |
| 208870 | 11/1966 | Sweden | 15/144.4 |
| 590855 | 7/1947 | United Kingdom | 15/144.4 |
| 686252 | 1/1953 | United Kingdom | 15/144.4 |
| 2233882 | 1/1991 | United Kingdom | 15/104.002 |

*Primary Examiner*—Mark Spisich
*Attorney, Agent, or Firm*—Jack C. Munro

[57] ABSTRACT

A surface cleaning appliance which has an operating head which is mounted onto a single base member. The single base member includes a disengageable connection which permits connecting of different operating heads to a handle assembly. The handle assembly is movable between a collapsible position of minimum length and an extended position of maximum length. The operating head is to be adjustable to various positions relative to the handle assembly. A typical operating head would be a roller which has a pressure sensitive adhesive material wound around the peripheral surface of the roller.

2 Claims, 3 Drawing Sheets

SURFACE CLEANING APPLIANCE

BACKGROUND OF THE INVENTION

1.) Field of the Invention

The subject matter of this invention is directed to a cleaning appliance which facilitates cleaning of surfaces such as floors, walls and ceilings and can also be used on a tiled, linoleum or carpeted surface to effect the removal of lint and hair.

2.) Description of the Prior Art

Surface cleaning appliances have long been known. A typical surface cleaning appliance would be a broom or mop. Brooms and mops are totally ineffective in cleaning certain types of surfaces. An example of one particular type of surface would be a carpet. Tile, linoleum and carpets have a tendency to collect and retain lint, human hair and animal hair. The only type of cleaning appliance that facilitates cleaning of such surfaces would be to use a vacuum cleaner. However, vacuum cleaners are normally not designed to be used to do a "quick cleanup". Since vacuum cleaners are relatively bulky in size, it requires the user to pull the vacuum from a storage area, use the vacuum and then return it to the storage area which means that generally the vacuum cleaner is intended to be used only when performing a major cleaning operation.

People, during the time that they are shampooing and drying hair commonly lose a significant number of hair strands each and every day. These hair strands fall and accumulate onto the floor. It would be desirable to use some kind of a cleaning appliance which facilitates the picking up of this hair and would do so quickly and easily. For frequent cleaning of carpets in the past, there have been used what is termed a carpet sweeper. However, a carpet sweeper is not really effective at picking up hair.

There have previously been manufactured lint removers for clothing and fabrics with these lint removers being constructed in the form of a roller attached to a handle. The roller has mounted on its peripheral surface an adhesive layer. The adhesive layer is to be rolled along the fabric or clothing to remove foreign particles. However, in the past, due to their short handle, none of these lint removers could feasibly be used for purposes other than short range for clothing and fabric.

SUMMARY OF THE INVENTION

One of the primary objectives of the present invention is to provide a cleaning appliance for surfaces such as floors, carpets, walls and ceilings that utilizes an adhesive layer on a roller for removing hair, lint and dust from the surface.

A further objective of the present invention is to provide a surface cleaning appliance which will be inexpensive to manufacture and therefore can be sold to the ultimate consumer at a reasonable cost.

Another objective of the present invention is to construct a surface cleaning appliance which has an elongated handle facilitating the cleaning of floors, ceilings and walls from a distance spaced from that surface thereby eliminating the need for stooping when cleaning of a floor or utilizing of a step ladder when cleaning of a ceiling.

Another objective of the present invention is to construct a surface cleaning appliance which facilitates cleaning at difficult to reach areas such as behind toilets.

Another objective of the present invention is to construct a surface cleaning appliance which permits various different types of operating heads to be connected to an extendable handle with the operating head comprising different types of cleaning devices such as a small broom, a small comb, a dust rag head, a feather duster head, a sponge head as well as a roller with an adhesive surface.

Another objective of the present invention is to construct a unit that will help handicapped and elder users in cleaning with such devices.

The surface cleaning appliance of the present invention is to utilize an operating head which may either comprise an adhesive roller, a small broom, a feather duster, rag head, comb or sponge head and this operating head is to be attached to a handle assembly. The attachment to the handle assembly is by means of a disengageable snap lock. The operating head may be adjusted to different positions relative to the handle assembly. The handle assembly is to be movable from a collapsed position of minimum length to an extended position of maximum length with the collapsed position facilitating storage and the extended length facilitating usage. When the operating head comprises an adhesive type of roller, the adhesive type of roller is to be rotatably mounted on a shaft. One form of mounting would be for an end disc of the roller to lockingly engage with a series of lugs formed on a mounting plate mounted on the shaft thereby fixing in position the roller on the shaft with the roller being freely rotatable on the shaft. The other form of mounting would be to construct the shaft 24 integral with shaft end 34. The roller may be adjusted in angular position relative to the handle assembly between an acute angle to an obtuse angle with the right angle position being the most commonly used.

DETAILED DESCRIPTION OF THE PREFERRED EMBODIMENT

Figure 1:
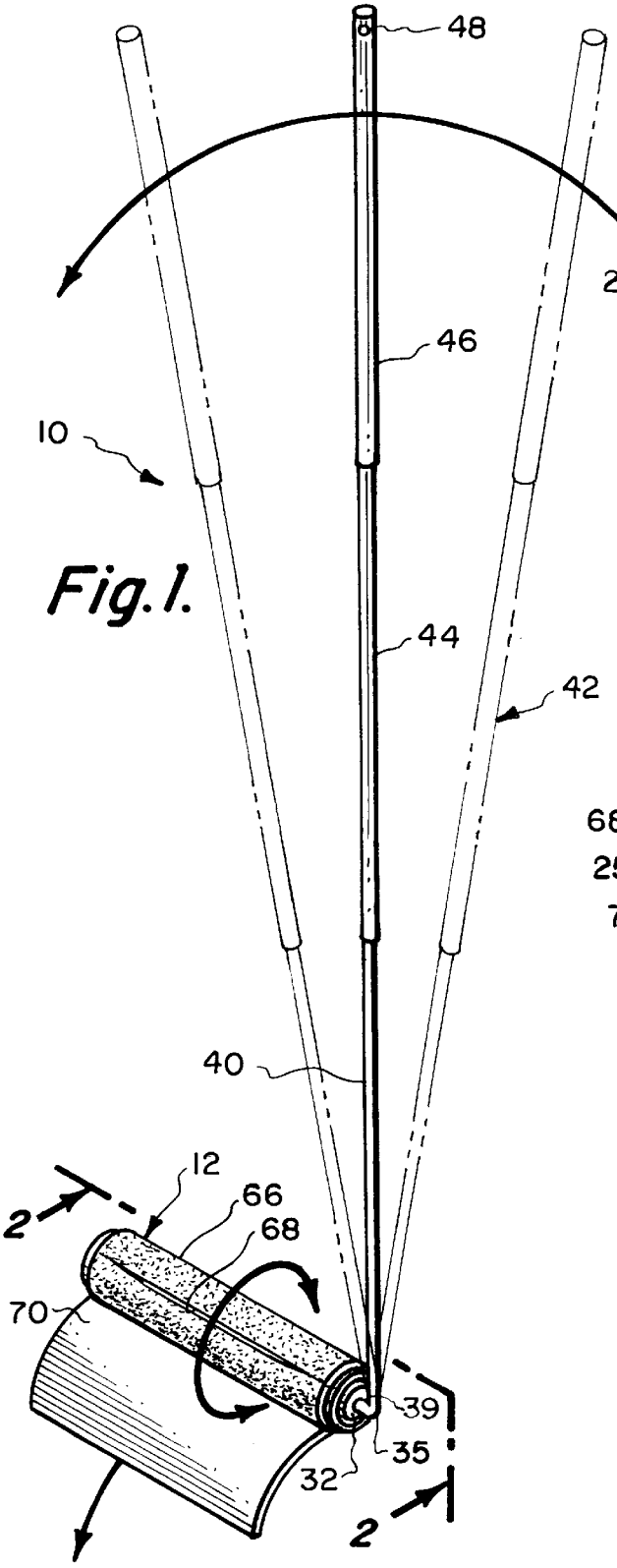
FIG. 1 is an isometric view of the surface cleaning appliance of the present invention showing the operating head in the form of a roller which has an adhesive peripheral surface.

Referring particularly to the drawings, there is shown in FIG. 1 the surface cleaning appliance 10 of this invention.

The surface cleaning appliance 10 is shown in conjunction with an adhesive roller assembly 12 as the operating head which is used to affect the cleaning operation. However, it is considered to be within the scope of this invention that other operating heads could be used such as a small broom, dust rag, tassel comb, feather duster or a sponge head. The adhesive roller assembly 12 has a through opening 14 which is centrally mounted within a roller body 16. The roller body 16 comprises four in number of elongated ribs 18 which are located equiangularly spaced apart about the center through opening 14. One end of the elongated ribs 18 are integrally connected to an outer end cap 20. The outer end cap 20 includes a center hole 22. Inner end cap 50 includes a center hole 51. Mounted within the center hole 22 is the outer end of a shaft 24. The roller assembly 12 rotates around shaft 24. Mounted along the longitudinal length of the shaft 24 are a series of discs 26. The discs 26 abut against the inner surface of the elongated ribs 18. It is the function of the discs 26 to provide support for the elongated ribs 18.

The inner end of the shaft 24 includes a tapered collar 28. Behind the tapered collar 28 is an annular recess 30. The annular recess 30 abuts against an enlarged disc 32 which is fixedly mounted onto a shaft end 34. The enlarged disc 32 is rotatably mounted into end cap 50. The shaft end 34 is formed in a shape of a right angle. The shaft end 34 terminates in a necked-down extension 36 which forms a shoulder 39. The necked-down extension 36 includes a spring biased ball 38. The necked-down extension 36 slips snugly into hole 41 formed in the outer end of handle member 40. The spring biased ball 38 functions as a "snap lock" for engagement of the operating head 12 with handle member 40 of a handle assembly 42. Different operating heads, such as a small broom, dust rag head, feather duster head, tassel comb or sponge head, could be substituted for the adhesive roller assembly 12 all of which are to connect with hole 41 and spring biased ball 38. Connecting with handle member 40 in a telescoping manner is a handle member 44. In a similar manner, a handle member 46 telescopingly connects with the handle member 44.

It is envisioned that the normal length of the handle member 40 will be about twelve inches. A similar length will be for the handle members 44 and 46. The handle members 40, 44 and 46 are capable of being located in a concentric overlapped arrangement which will result in the handle members 40, 44 and 46 being located in a collapsed position which will be about twelve inches in length. This would be the position for storage of the surface cleaning apparatus of this invention. A typical storage would be by hanging of the surface apparatus 10 onto a hangar utilizing of the hole 48 formed within the handle member 46. When it is desired to use the surface cleaning apparatus 10 of this invention, the user only needs to pull in an outward direction the handle members 44 and 46 to the position shown in FIG. 1. The handle members 40, 44 and 46 can be constructed that when a slight twist is applied, slight rotational relative movement will occur between handle members 44 and 40, and between handle members 46 and 44. This slight twist will result in a locking action for the handle assembly 42 so that it will remain in the extended position while the surface cleaning appliance is being used. This locking arrangement is achieved by instead of constructing the handle members 40, 44 and 46 in a circular configuration, such are constructed in a slightly out-of-round configuration. This out-of-round configuration will result in a binding action between handle members 40 and 44, and between handle members 44 and 46. When it is desired to move the handle assembly 42 to the collapsed position, it is only necessary to twist the handle members 44 and 46 in the reverse direction which will then permit the handle members 44 and 46 to telescope over the handle member 40. This telescoping arrangement of the handle assembly 42 is deemed to be quite common in use on other types of apparatuses such as a golf ball retrieving device utilized for retrieving golf balls from within water.

The roller body 16 also has an inner end cap 50. The inner end cap 50 has a center hole 51. The enlarged disc 32 is to be positioned directly adjacent the center hole 51. The tapered collar 28 is to be inserted past an annular series of deflectable fingers 54 with four in number of such fingers being shown. The deflectable fingers 54 are integral with the inner end cap 50. Once the deflectable fingers 54 deflect and pass over the tapered collar 28, the deflectable fingers 54 then come to rest within the annular recess 30 thereby locking longitudinally in position the shaft 24 relative to the roller body 16.

A roller tube 56 is to be forced over the outer end cap 20 and come to rest between the outer end cap 20 and the inner end cap 50. The outer end cap 20 includes a series of slits 58 which divides a portion of the outer end cap 20 into a plurality of deflectable members 60. Each of the deflectable members 60 include a radially outwardly extending ridge 62 with a similar ridge 63 being formed on the inner end cap 50. The roller tube 56 is to rest between the ridges 62 and 63 which functions to somewhat lock in position the roller tube 56 on the roller body 16. Normally, the roller tube 56 will be constructed of cardboard.

Wound on the roller tube 56 are a plurality of sheets 64. Each of the sheets 64 includes an outer surface upon which an adhesive 66 has been applied. The sheets 64 are cut longitudinally by slit 68. Prior to usage, the outer adhesive layer 66 is covered by means of a protective cover 70.

In order to operate the adhesive roll surface cleaning appliance 10 of this invention, the user first grasps the exterior surface of the protective cover 70 and extends the handle assembly 42 to the extended configuration shown in FIG. 1. The handle assembly 42 is then twisted which is now locked in this position. The protective cover 70 is then removed which then permits the outermost sheet of the sheets 64 to be rolled onto the surface which is to be cleaned. When the outermost adhesive layer 66 of the outermost sheet 64 becomes so covered with particulate matter that it is no longer able to pick up any more particulate matter, it is only necessary to grasp the outermost sheets 64 in the area of the slit 68 and remove that from the next inner sheet 64. This then permits the inner sheet 64 to be used to effect picking up of the particulate matter. This procedure is to be repeated until there are no more adhesive sheets 64 which will then require that the empty roller tube 56 is to be removed and discarded with the new adhesive roller tube 56 to be inserted between the end caps 20 and 50.

Figure 6:
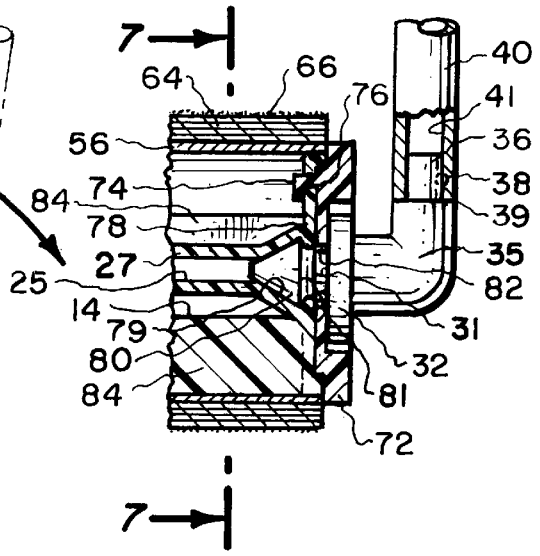
FIG. 6 is a cross-sectional view through a modified form of connection arrangement between the end of the roller and the shaft located directly adjacent the handle assembly.
Figure 7:
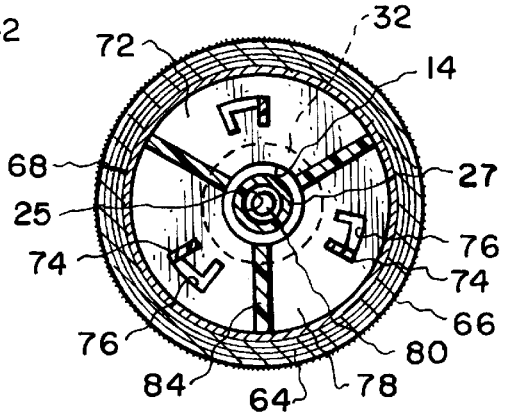
FIG. 7 is a cross-sectional view taken along line 7—7 of FIG. 6.
Figure 2:
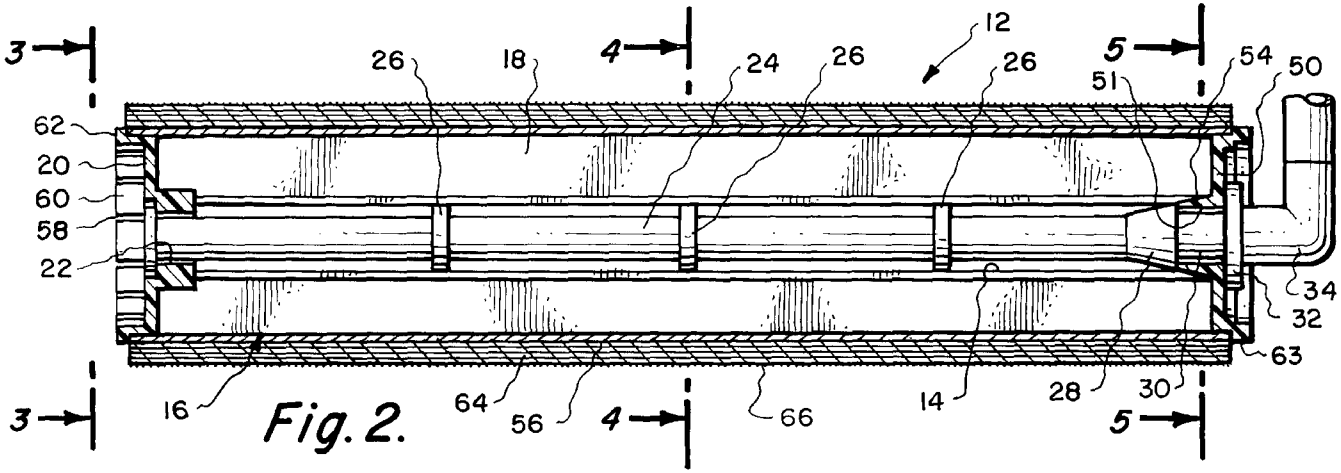
FIG. 2 is a longitudinal cross-sectional view through the roller of FIG. 1 taken along line 2—2 of FIG. 1.
Figure 4:
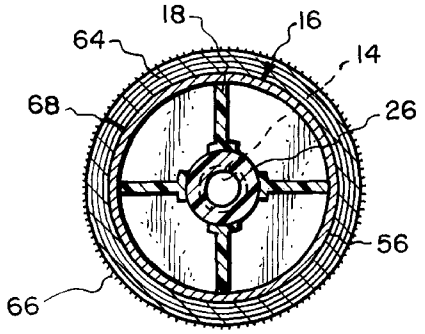
FIG. 4 is a transverse cross-sectional view through the roller taken along line 4—4 of FIG. 2.
Figure 5:
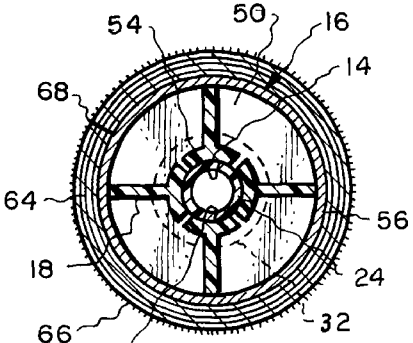
FIG. 5 is a transverse cross-sectional view through the roller taken along line 5—5 of FIG. 2 located directly adjacent the end of the roller which is connected to the handle assembly.
Figure 3:
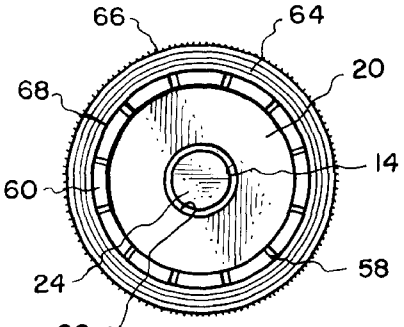
FIG. 3 is an end view of the roller taken along line 3—3 of FIG. 2.
Figures 8, 9, 10, 11, 12:
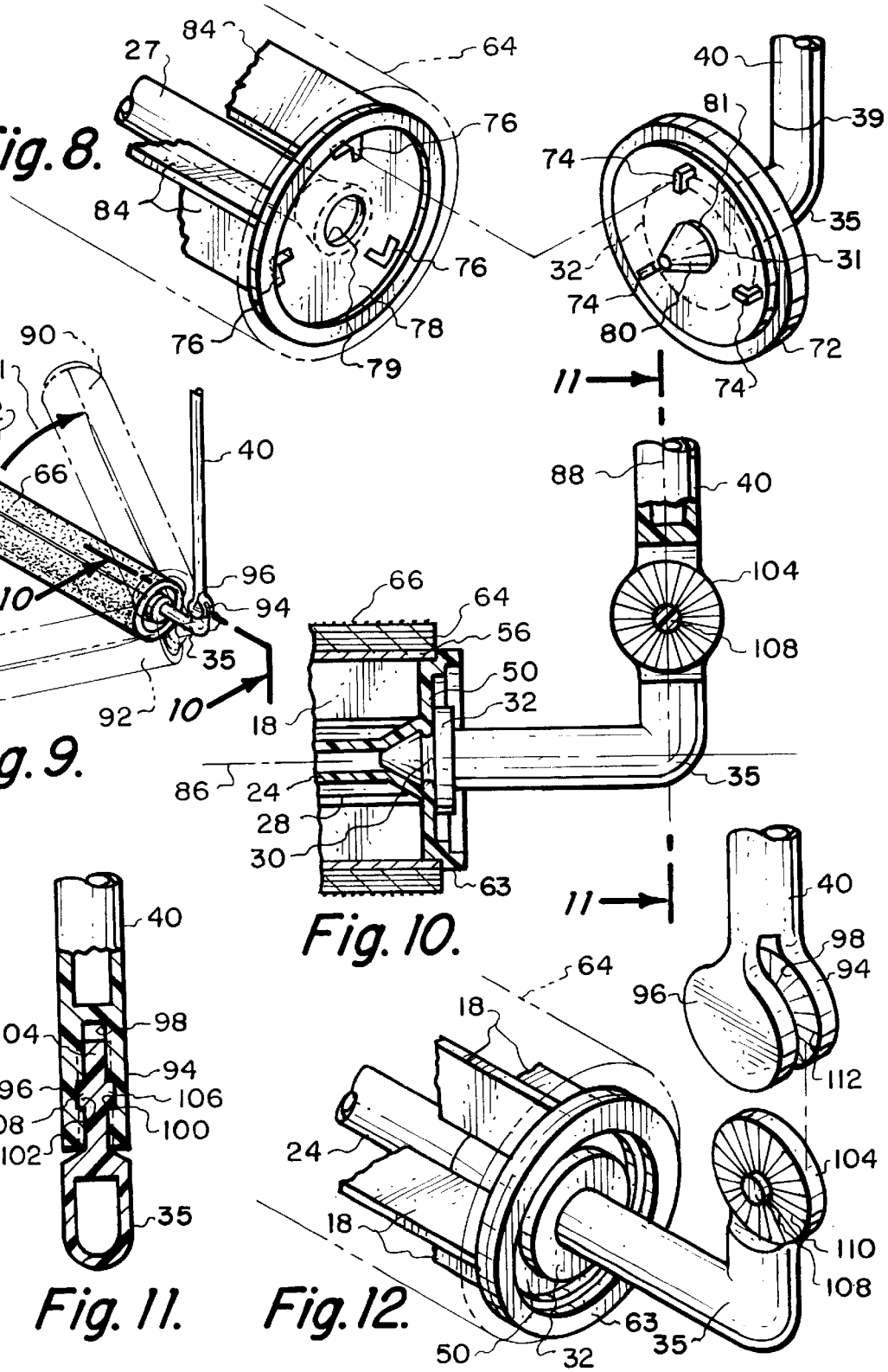
FIG. 8 is an exploded isometric view of the connection arrangement of FIG. 6.
FIG. 9 is an isometric view of a modified form of roller showing how the roller can be angularly adjusted relative to the handle assembly.
FIG. 10 is a segmented view, partly in cross-section, of the modified form of roller of FIG. 9 showing the joint that is used to achieve the adjustment of the roller.
FIG. 11 is a cross-sectional view taken along line 11—11 of FIG. 10.
FIG. 12 is an exploded isometric view of the joint which permits the adjustment of the roller of FIG. 9.

Referring particularly to FIGS. 6–8 of the drawings, there is shown a modified form of inner end cap 72 which has formed on its inwardly extending surface a plurality of lugs 74. Each lug 74 is capable of being conducted through a right angle (bayonet) shaped slot 76 formed within a disc 78 which is mounted across the inner end of the roller tube 56. Centrally formed within the disc 78 is a cone-shaped cavity 79 formed within shaft 27 which connects with tapered collar 80. With each lug 74 so engaged with a slot 76, it's only necessary on initial assembly to exert a twisting motion of a few degrees which will result in interlocking of the modified form of inner end cap 72 to the disc 78. The inner end cap 72 connects with annular recess 31 positioned directly adjacent the tapered collar 80. The tapered collar 80 is forced through the center hole 82 formed within the inner end cap 72 and located in cone-shaped concavity 79. The tapered collar 80 is fixed to shaft end 35. The inner end cap 72, after permanent installation in position within annular recess 31, is capable of free rotation relative to shaft end 35. However, axial movement of inner end cap 72 is prevented by the enlarged disc 32 and the shoulder 81 of tapered collar 80. The adhesive roller assembly 12 of FIGS. 6–8 is freely rotatably supported on the shaft end 35 similar to what was previously discussed in relation to FIGS. 1–5. The adhesive roller assembly 12 of FIGS. 6–8, instead of having four in number of the ribs 18, has three in number of ribs 84. The ribs 84 are equiangularly spaced apart. The ribs 84 are to abut against shaft 27 which is to provide support for the ribs 84. Shaft 27 has a hollow center 25 which connects with cone-shaped concavity 79.

It may be desirable to mount the adhesive roller assembly 12 relative to the handle member 40 so that the angular position of the roller assembly 12 can be varied. Normally, the longitudinal center axis 86 is located perpendicular to the longitudinal center axis 88 of the handle assembly 42. However, if during the cleaning operation the user desires to locate the longitudinal axis 88 at other than perpendicular to the surface that is being cleaned, the surface of the roller assembly 12 will not be located flush on the surface to be cleaned. Therefore, it may be desirable to move the roller assembly 12, in the direction of arrow 91, to either an acute angle position as is depicted by dotted lines 90 in FIG. 9, or to the obtuse angle position, in the direction of arrow 93, depicted by dotted lines 92 in FIG. 9. The movement of the roller assembly 12 to the particular position is to be selected by the user based on the requirements of the particular cleaning operation.

In order to permit this movement, the handle member 40, at its outer end, is bifurcated forming legs 94 and 96. Between the legs 94 and 96 is located a slot 98. The sidewalls of the slot 98 are located parallel to each other. Formed within the sidewall of the leg 94 is a center recess 100. A similar center recess 102 is formed within the sidewall of the leg 96.

The shaft end 35 is formed into a disc 104. On one side of the disc 104 is located a shaft protrusion 106 with a similar shaft protrusion 108 extending from the opposite surface of the disc 104. The opposite surfaces of the disc 104 are serrated forming a series of ridges 110. In a similar manner, the sidewalls of the slot 98 are serrated forming a series of ridges 112.

The disc 104 is to be located within the slot 98 in a close fitting manner. Actually, the legs 94 and 96 are to deflect during mounting of the disc 104 within the slot 98 with the legs 94 and 96 moving to a non-deflected state when protrusion 106 is located within center recess 100 and protrusion 108 is located within center recess 102. The ridges 110 and 112 are to interengage with each other thereby locking in position the roller assembly 12 relative to the handle assembly 42. However, when it is desired to move the roller assembly 12 to either the dotted line position 90 or 92, it is only necessary to manually deflect the roller assembly 12 causing the disc 104 to rotate within the slot 98 with the interengaging ridges 110 and 112 riding over each other during the adjusting movement. When the roller assembly 12 has been moved to the desired position, the ridges 110 and 112 will again interlock and cause the roller assembly 12 to remain in the selected position.

It is to be understood that different operating heads could be substituted for the adhesive roller assembly 12. Each operating head has a disc 104 which is to engage with the slot 98. Each disc 104 is manually disengageable from the slot 98 to permit reconnection with a separate disc 104 of a different operating head.

What is claimed is:

1. A surface cleaning appliance comprising:

an operating head to be applied to a surface to effect cleaning of the surface, said operating head being mounted on a single base member;

connection means mounted on said single base member;

a handle assembly mounted to said single base member by said connection means, said handle assembly being movable between a collapsible position and an extended position, said collapsible position locating said handle assembly at a minimum length, said extended position locating said handle assembly at a maximum length, said connection means permitting fixing attachment of said handle assembly to said single base member and also permitting disengagement of said handle assembly thereby providing for reconnection of said handle assembly with another said operating head; and adjustment means included within said single base member, said adjustment means permitting adjusting of the position of said operating head relative to said handle assembly, said adjustment mans comprising: a bifurcated outer end of said handle assembly forming a pair of legs between which is formed a slot, said slot having sidewalls which are serrated forming a series of first ridges, said single base member comprising a shaft which terminates in a shaft end, said shaft end comprising a disc, said disc having opposite surfaces with each said surface being serrated forming a a series of second ridges, said disc being locatable within said slot with said first ridges and said second ridges interengaging forming interlocking ridges, said interlocking ridges fix the position of said handle assembly relative to said single base member after adjustment of said operating head.

2. A surface cleaning appliance comprising:

an operating head to be applied to a surface to effect cleaning of the surface, said operating head being mounted on a single base member;

connection means mounted on said single base member;

a handle assembly mounted to said single base member by said connection means, said handle assembly being movable between a collapsible position and an extended position, said collapsible position locating said handle assembly at a minimum length, said extended position locating said handle assembly at a maximum length, said connection means permitting fixing attachment of said handle assembly to said single base member and also permitting disengagement of said handle assembly thereby providing for reconnection of said handle assembly with another said operating head;

said operating head comprising a roller, said roller having a length of pressure sensitive adhesive material wound around the periphery of said roller, said roller being low frictionally rotatable on said single base member, said roller terminating in a pair of ends, said single base member being mounted to only one said end thereby mounting said roller on said single base member in a cantilevered manner; and said single base member comprising a shaft, a mounting plate rotatably mounted on said shaft, said mounting plate including a lug assembly which includes a plurality of lugs, one of said ends of said roller terminating in a disc, said disc having a plurality of lug receiving openings, in order to mount said roller on said shaft said lug receiving openings are each to engage with a said lug thereby locking of said roller onto said mounting plate.

* * * * *